US005085064A

United States Patent [19]

Hayashi et al.

[11] Patent Number: 5,085,064

[45] Date of Patent: Feb. 4, 1992

[54] DRUM TYPE WASHING AND DEHYDRATING MACHINE

[75] Inventors: Shoichi Hayashi; Hidetoshi Ishihara; Atsushi Ueda, all of Nagoya, Japan

[73] Assignee: Mitsubishi Jukogyo Kabushiki Kaisha, Tokyo, Japan

[21] Appl. No.: 537,705

[22] Filed: Jun. 14, 1990

[30] Foreign Application Priority Data

Jun. 20, 1989 [JP] Japan ..... 1-157153

[51] Int. Cl.[5] ..... D06F 37/24

[52] U.S. Cl. ..... 68/23.001; 494/82; 248/638; 248/636; 74/574; 68/12.06

[58] Field of Search ..... 210/144; 494/82; 68/23.1, 23.3, 12.06; 188/266, 382, 279; 73/574, 526, 522; 248/636, 638; 74/574; 52/167

[56] References Cited

U.S. PATENT DOCUMENTS

| | | | |
|---|---|---|---|
| 1,247,798 | 11/1917 | Dohn . | |
| 1,301,055 | 4/1919 | Humberger . | |
| 1,641,780 | 9/1927 | Parker . | |
| 1,847,159 | 3/1932 | Adams . | |
| 2,406,494 | 8/1946 | Ferris . | |
| 2,580,435 | 1/1952 | Kirby . | |
| 2,693,098 | 11/1954 | Young | 68/23.3 |
| 2,807,952 | 10/1957 | Bochan et al. | 210/144 X |
| 2,813,415 | 11/1957 | Clark | 68/23.1 |
| 2,908,086 | 10/1959 | Fuhring . | |
| 2,987,189 | 6/1961 | Evjen | 68/23.3 X |
| 3,014,591 | 12/1961 | Stone et al. | 210/144 |
| 3,116,243 | 12/1963 | Khan et al. . | |
| 3,116,626 | 1/1964 | Moschetti et al. . | |
| 3,226,016 | 12/1965 | Couper et al. | 68/23.3 X |
| 3,302,433 | 2/1967 | Nallinger . | |
| 3,304,751 | 2/1967 | Schwing . | |
| 3,358,301 | 12/1967 | Candor . | |
| 3,387,310 | 6/1968 | Marshall . | |
| 3,387,385 | 6/1968 | Mandarino, Jr. et al. . | |
| 3,444,710 | 5/1969 | Gaugler et al. . | |
| 3,524,263 | 8/1970 | Odle, Jr. et al. . | |
| 3,546,903 | 12/1970 | Hertig . | |
| 4,207,638 | 6/1980 | Biesinger et al. . | |
| 4,285,219 | 8/1981 | Grunewald . | |

FOREIGN PATENT DOCUMENTS

| | | | |
|---|---|---|---|
| 677929 | 3/1965 | Belgium . | |
| 54165 | 10/1890 | Fed. Rep. of Germany . | |
| 829159 | 12/1951 | Fed. Rep. of Germany . | |
| 890037 | 8/1953 | Fed. Rep. of Germany . | |
| 2513660 | 10/1975 | Fed. Rep. of Germany . | |
| 3323148 | 12/1983 | Fed. Rep. of Germany | 68/23.1 |
| 1113123 | 3/1956 | France . | |
| 1370320 | 7/1964 | France . | |
| 6351899 | 3/1983 | Japan . | |
| 183815 | 4/1923 | United Kingdom . | |
| 467594 | 6/1937 | United Kingdom . | |
| 858182 | 1/1961 | United Kingdom . | |
| 2095705 | 10/1982 | United Kingdom . | |

*Primary Examiner*—Frankie L. Stinson

*Attorney, Agent, or Firm*—Birch, Stewart, Kolasch & Birch

[57] ABSTRACT

In a drum type washing and dehydrating machine which is elastically supported, the drum type washing and dehydrating machine according to the present invention comprises a vibration fixing device having a clamping part for fixing or releasing a base on which is installed a treatment drum system, and means for releasing the vibration fixing device from its preceding fixed state, in the washing and dehydrating processes, after the vibrations of the machine passed the vibration resonance point of the system.

3 Claims, 4 Drawing Sheets

DRUM TYPE WASHING AND DEHYDRATING MACHINE

FIELD OF THE INVENTION AND RELATED ART STATEMENT

The present invention relates to a drum type washing and dehydrating machine used for realizing vibration prevention at the time of dehydration in a washing machine such as a dry cleaner and a washing and dehydrating machine.

In a dry cleaner, for example, which cleans and dries clothes and the like using a solvent such as perchloroethylene, subsequent to the cleaning of the clothes and the like in a treatment drum, dehydration is performed by means of the centrifugal force generated by a high-speed rotation of the treatment drum. In this case, however, if the clothes and the like are nonuniformly distributed within the treatment drum, a large exciting force is generated in the treatment drum due to an unbalanced loading of the clothes and the like, which not only causes the main body of the dry cleaner to vibrate but also leads sometimes to vibration hazard through propagation of the vibrations to the surroundings via the ground.

In the case of a conventional dry cleaner A having a driving system as shown in FIG. 4, for example, the following method is adopted as a means of preventing the vibration hazard. In FIG. 4 which shows an example of the treatment drum, 2 is a washing motor which drives the treatment drum 1 at low speed at the time of washing and drying; 3 is a dehydration motor which removes the used solution by centrifugal action by driving the treatment motor 1 at high speed at the time of dehydration, 4 is an electromagnetic clutch which disconnects the link between the washing motor 2 at the time of driving the dehydration motor 3; 5, 6, 7, 8, 9 and 10 are V pulleys; and 11, 12 and 13 are V belts. In this driving system, the vibrations of the dry cleaner main body are detected by sensors such as an acceleration type vibration detector, a vibration displacement measuring instrument or the like (not shown) that are attached to the dry cleaner main body in FIG. 4, and when the vibrations exceed a predetermined value, a vibration monitoring circuit is actuated to temporarily halt the high speed rotation that drives the treatment drum 1 by the dehydration motor 3. Then, the unbalanced distribution of the clothes and the like is corrected manually, and the driving system is actuated again to execute dehydration by generating a transition of the treatment drum 1 from the low speed rotation by the washing motor 2 to the high speed rotation by the dehyration motor 3.

In the conventional example described above, it is not infrequent to be required to repeat the above-mentioned imbalance correction operation several times, thereby necessitates a prolongation of the treatment time. Because of this, a method for reducing the power due to the vibrations transmitted to the ground has been employed in which the dry cleaner A, equipped with the driving system and the treatment system, shown in FIG. 4 is fixed on a base 20 shown in FIG. 5, and an elastic supporting body 21 is provided between the base 20 and the ground 22. However, a new problem arises in which a resonance point a is generated, due to the spring constant of the elastic supporting body 21 and the mass on the elastic supporting body 21, in a graph showing the relation between the amplitude and the number of revolutions of the drum shown in FIG. 6. This induces vibrations as shown schematically in FIG. 7, requiring eventually a repetition of the operation for correcting the imbalanced condition of the clothes. Moreover, there was also a drawback in that when the treatment drum is installed on the elastic supporting body 21, there occurs a weakening in the impacting force at the time of the fall of the laundry which is lifted by the beaters, not shown, that are fitted to the treatment drum, during the washing process which is operated in general at a revolution number that is smaller than that of the resonance point a.

OBJECT AND SUMMARY OF THE INVENTION

It is the object of the present invention to provide a drum type washing and dehydrating machine which can resolve the aforementioned problems that existed in the conventional machine.

In a drum type washing machine in which a base having a treatment system installed thereon is supported elastically by the ground, the drum type washing machine in accordance with the present invention is characterized in that it comprises a vibration fixing device which includes a clamping part and an actuator that actuates the clamping part, and fixes or releases the base by the operation of the actuator, and control means which detects the vibrations of the base, and actuates the actuator based on the measured frequency of the vibrations.

In accordance with the present invention, by fixing the base 20 in FIG. 5 until the number of revolutions of the drum exceeds the range where strong vibrations at the resonance point occur, preferably until the number of revolutions exceeds $\sqrt{2}$ times the number of revolutions at the resonance point shown in FIG. 6, and releasing the fixation of the base when the number of revolutions surpasses the above-mentioned value to permit the vibrations on the elastic supporting body, it becomes possible to prevent the strong vibrations at the resonance point and a reduction in the mechanical power on the elastic supporting body due to the operation of washing.

In accordance with the present invention, it is possible to prevent the vibrations at the resonance point without reduction in the mechanical power due to falling of the laundry during the washing, and to reduce the power transmitted to the ground which takes place during the high-speed rotation.

DETAILED DESCRIPTION OF PREFERRED EMBODIMENTS

Figure 1:
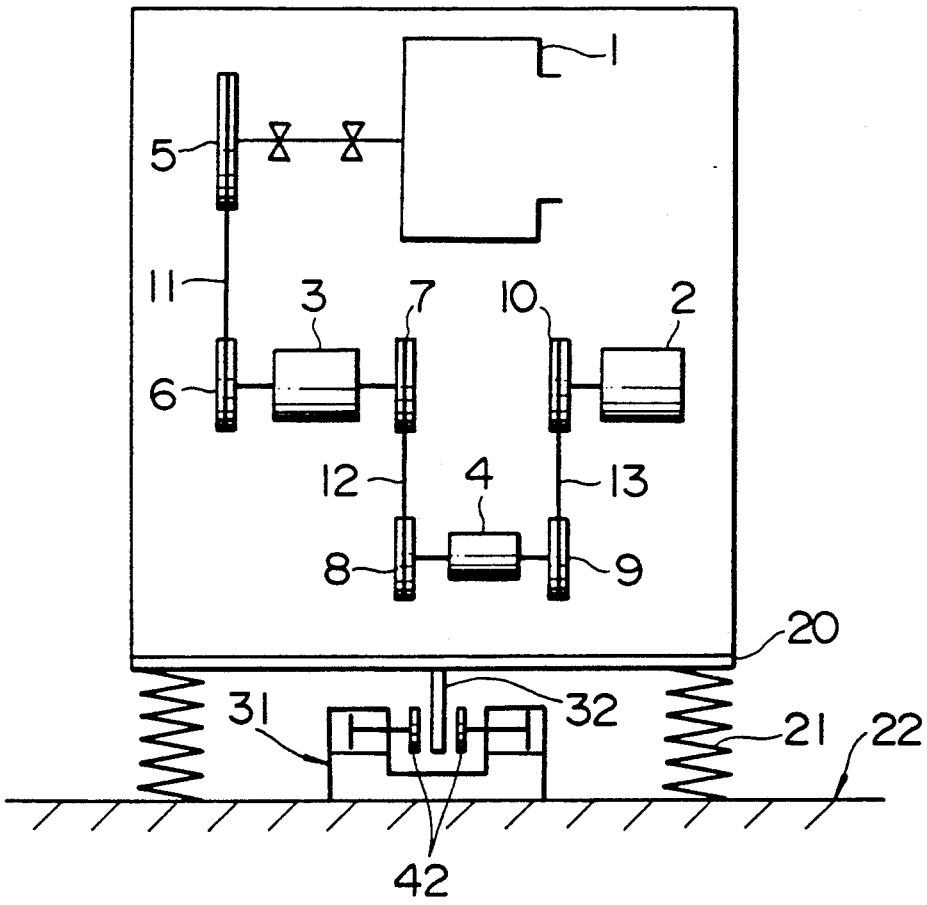
FIG. 1 is a conceptual side elevation of the drum type washing-dehydrating machine in accordance with an embodiment of the present invention.

FIG. 1 is a side elevation showing an embodiment of the present invention.

Figure 5:
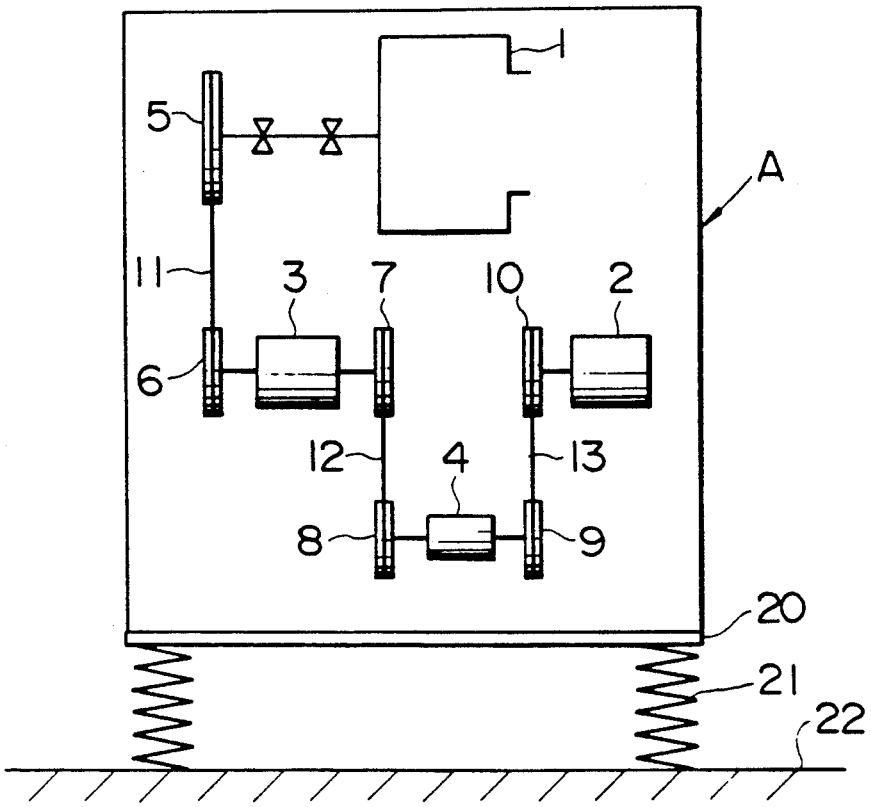
FIG. 5 is a conceptual side elevation showing a drum type washing and dehydrating machine in which an improvement is attempted over the machine shown in FIG. 4.
Figure 6:
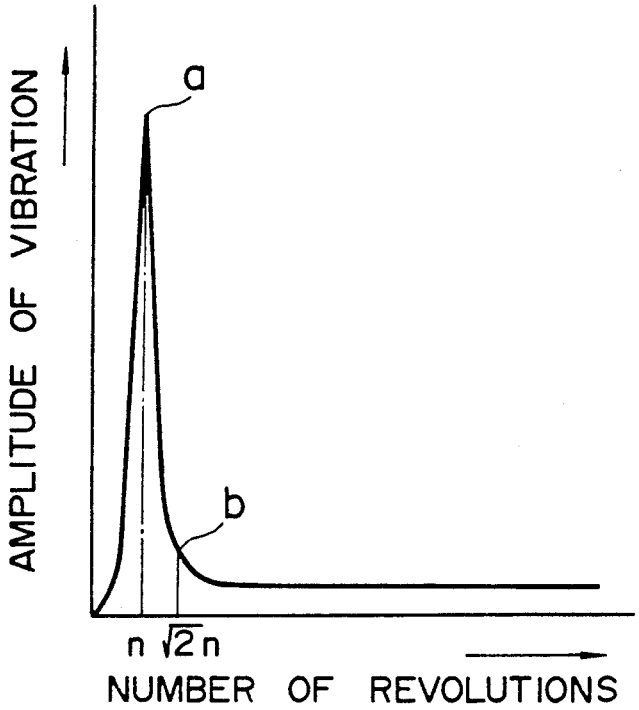
FIG. 6 is a characteristic curve showing the relation between the number of revolutions of the drum and the amplitude of vibration for the drum type washing and dehydrating machine.
Figure 7:
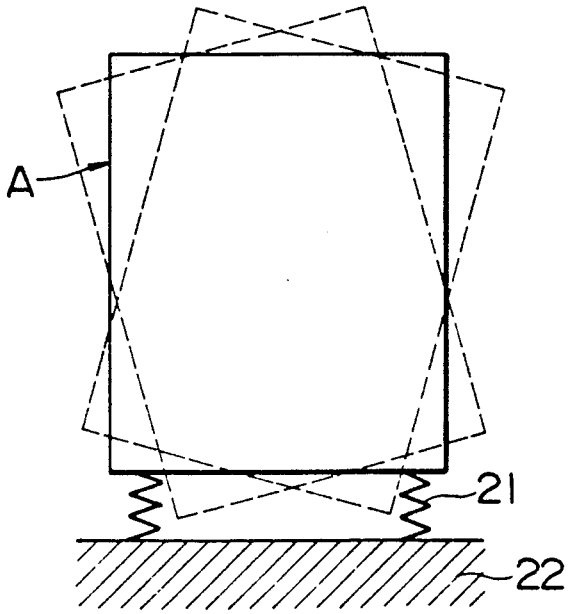
FIG. 7 is a simulation diagram showing the state of the drum type washing and dehydrating machine at the resonance point for the improvement shown in FIG. 5.

In FIG. 1, the components identical to those shown in FIG. 5 are assigned identical symbols, namely, 1 is a treatment drum; 2 is a washing motor, 3 is a dehydration motor; 4 is an electromagnetic clutch, 5, 6, 7, 8, 9 and 10 are V pulleys; 11, 12 and 13 are V belts, 20 is a base and 21 is an elastic supporting body. Since the operation of each of these elements is identical to that of the corresponding element in FIG. 5, a further description will be omitted.

In FIG. 1, describing only the differences from the elements shown in FIG. 5, 32 is a plate fastened to the base 20, and 31 is a vibration fixing device for fixing the plate from both sides, which is fastened to the ground 22.

Figure 2:
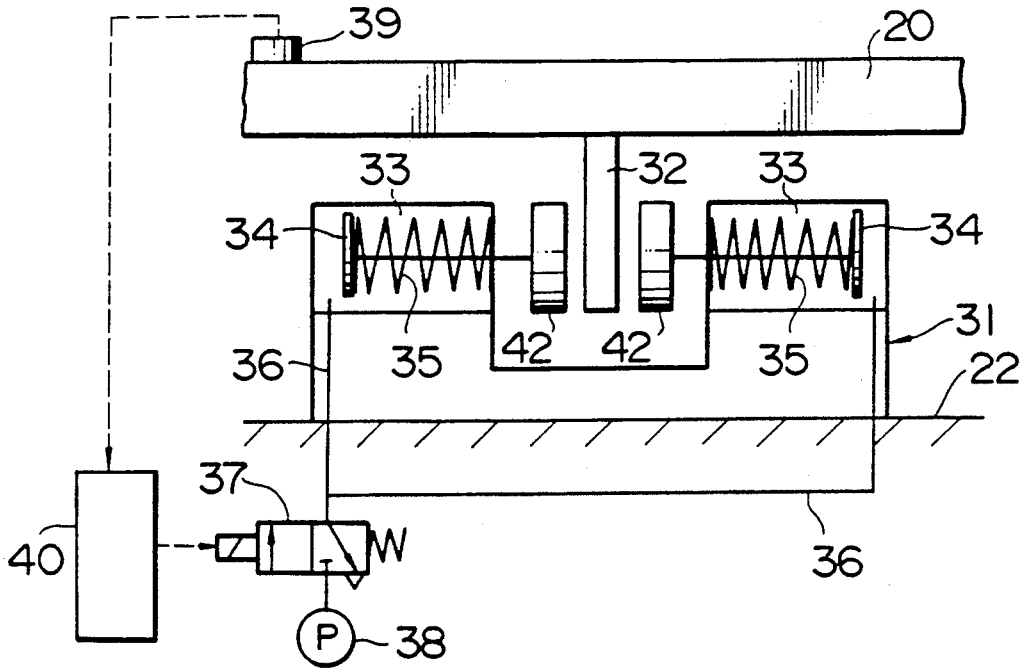
FIG. 2 and FIG. 3 are detailed diagrams showing the operation of the vibration fixing device in FIG. 1.
Figure 3:
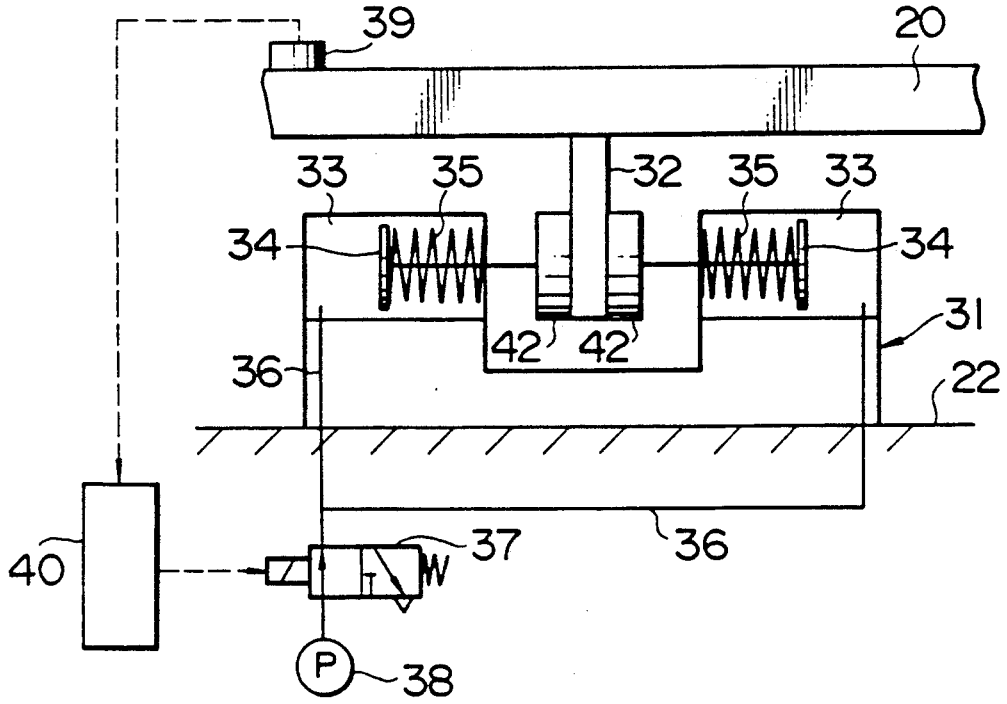
Figure 4:
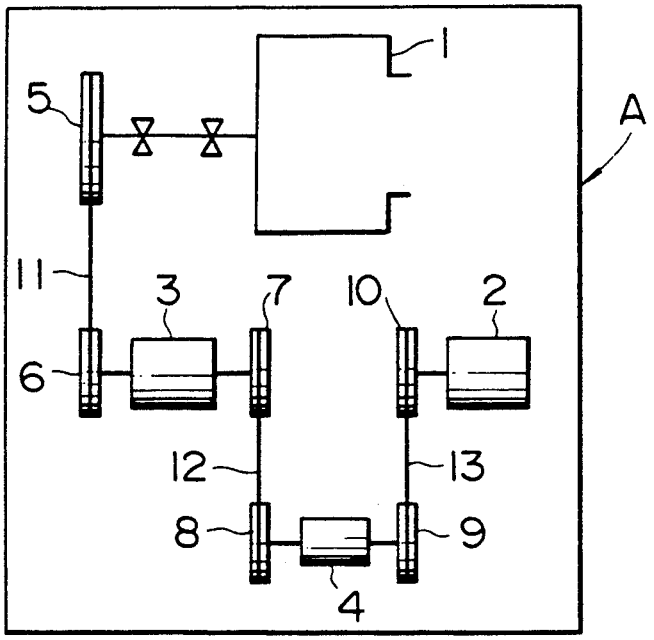
FIG. 4 PRIOR ART
FIG. 4 is a conceptual side elevation showing the conventional drum type washing and dehydrating machine.

To describe the vibration fixing device 31 by reference to the detailed diagram shown in FIG. 2, a pair of clamping boards 42 are arranged so as to pinch the plate 32 fastened to the base 20, with each of these clamping boards 42 linked with a piston 34 of an air cylinder 33. The piston 34 is energized by a spring 35 in the direction to be away from the plate 32. Further, an air pipe line 36 is connected to the air cylinder 33, and each of the pipe lines 36 is selectively communicated with a pump 38 or the atmosphere via an electromagnetic directional control valve 37. On the other hand, the electromagentic valve 37 is controlled based on the frequency of vibrations of the base 20 detected by an acceleration type vibration detector 39 or the like. Namely, the frequency detected by the detector 39 is compared with a value set beforehand in a controller 40, and when the detected frequency is smaller than the previously set value, the electromagnetic valve 37 is excited to let the pipe lines 36 be connected to a pump 38 as shown in FIG. 3 to send compressed air to the air cylinders 33 through the electromagentic valve 37, and the plate 32 is pinched by the clamping boards 42 to stabilize the base 20 as shown in FIG. 3. Further, when the detected frequency of the base 20 exceeds the previously set value, the electromagnetic valve 37 is demagnetized by the controller 40, whereby the pipe lines 36 are opened to the atmosphere. Accordingly, the compressed air in the air cylinders 33 is discharged, and as a result, the clamping boards 42 move away from the plate 32.

The operation of one embodiment of the present invention will now be described.

First, when washing is carried out with the laundry placed in the treatment drum 1 shown in FIG. 1, the base 20 is fixed with the vibration fixing device 31 as shown in FIG. 3. After completion of the washing, it proceeds to the dehydration process, and when the rotation speed passes the resonance point a, preferably when the number of revolutions of the drum exceeds $\sqrt{2}$ times the number of revolutions n at the resonance point, the vibration fixing device 31 is brought to the released condition as shown in FIG. 2 to reduce the vibration transmission to the ground (a reduction of about 10 to 20%, in general, of the transmission factor) due to imbalance that increases with the increase in the number of revolutions by means of the elastic supporting body 21. Accordingly, it becomes possible to prevent vibration hazard without deteriorating the mechanical power obtainable at the washing time (at the time of low speed of rotation).

What is claimed is:

1. In a drum type washing and dehydrating machine having a base, with a treatment drum system installed thereon, supported elastically on the ground, the drum type washing and dehydrating machine comprising a vibration fixing device, said device having a clamping part and an actuator for actuating said clamping part, said clamping part being selectively affixable to said base by operating said actuator, and control means for detecting the vibrations of said base and for actuating said actuator based on the detected vibration frequency of said base.

2. The drum type washing and dehydrating machine as claimed in claim 1, wherein said actuator consists of an air cylinder which is connected selectively to a source of compressed air or the atmosphere via an electromagnetic switching valve and wherein said control means is equipped with a vibration frequency detector which detects the vibrations of said base, and with a controller which computes the vibration frequency based on a signal from said detector, compares the detected vibration frequency with a reference vibration frequency value set in advance and selectively drives said electromagnetic switching valve in accordance with the detected vibration frequency to actuate said actuator to affix said clamping part on said base during the period when the detected vibration frequency of said base is smaller than said reference vibration frequency value, and to de-actuate said actuator to release said clamping part from said base during the period when the detected vibration frequency of said base is larger than said reference vibration frequency value.

3. The drum type washing and dehydrating machine as claimed in claim 2, wherein said reference vibration frequency value corresponds to the number of revolutions of the drum, the number being $\sqrt{2}$ times the number of revolutions of the drum corresponding to the resonance frequency of the machine.

* * * * *